United States Patent [19]

Tansuwan

[11] Patent Number: 4,463,723

[45] Date of Patent: Aug. 7, 1984

[54] APPARATUS FOR CONTROLLABLY OPENING A CARBURETOR CHOKE VALVE

[75] Inventor: Chusak Tansuwan, St. Louis, Mo.

[73] Assignee: ACF Industries, Incorporated, New York, N.Y.

[21] Appl. No.: 364,508

[22] Filed: Apr. 1, 1982

[51] Int. Cl.[3] ..... F02M 7/06

[52] U.S. Cl. ..... 123/438; 123/179 G; 261/39 R

[58] Field of Search ..... 123/437, 438, 179 G, 123/361; 261/39 R, 39 A, 39 E

[56] References Cited

U.S. PATENT DOCUMENTS

| | | | |
|---|---|---|---|
| 3,948,240 | 4/1976 | Hirosawa et al. | 123/179 G |
| 4,005,690 | 2/1977 | Hirosawa et al. | 261/39 E |
| 4,011,844 | 3/1977 | Hirosawa et al. | 261/39 E |
| 4,027,640 | 6/1977 | Hirosawa et al. | 261/39 E |
| 4,367,708 | 1/1983 | Nakamura et al. | 123/361 X |
| 4,391,249 | 7/1983 | Bianchi et al. | 123/438 |

*Primary Examiner*—Tony M. Argenbright
*Attorney, Agent, or Firm*—J. Joseph Muller

[57] ABSTRACT

Apparatus (1) for controllably opening the choke valve (V) of a carburetor (C). An actuator (3) is supplied signal elements of an electrical command signal. The actuator is responsive to the command signal elements to move a choke shaft (S) and open the choke valve. A spring (13) is connected to the actuator and the choke shaft to exert a choke valve opening force on the choke shaft when command signal elements are supplied to the actuator. A sensor (21) senses the temperature of the engine and generates an electrical signal representative thereof. A processor (23) processes the electrical signal from the sensor and generates and supplies signal elements of the electrical command signal to the actuator if the engine temperature represented by the electrical signal is less than a predetermined engine temperature. The choke valve is fully opened when engine temperature reaches the predetermined temperature.

14 Claims, 5 Drawing Figures

APPARATUS FOR CONTROLLABLY OPENING A CARBURETOR CHOKE VALVE

BACKGROUND OF THE INVENTION

This invention relates to carburetors for internal combustion engines, and more particularly to apparatus for controllably opening the choke valve of a carburetor.

Most carburetors have a choke valve at the inlet of the air passage through the carburetor. This choke valve is initially closed if the engine is cold when started. At start up, the choke valve is moved to a first open or "choke break" position and then gradually moved to a fully open position as the engine heats up. To accomplish this, the choke valve is controlled by both a vacuum motor of some type and a bimetalic coil. The vacuum motor is used to provide the initial choke opening or "choke break" when the engine first starts. From then on, the heat generated by the engine as it warms up is supplied to the bimetalic coil. This coil exerts a closing force on the choke valve which gradually lessens as the engine warms. This allows the choke valve to slowly open as the engine heats up until the choke valve is fully opened. Once the choke valve is fully opened, it remains open during the remainder of engine operation.

It is known that the majority of engine emissions occur during the choke opening cycle because the engine is usually provided a richer fuel mixture at this time. Further, there is a recent Federal requirement that the choke break mechanism of the carburetor be tamperproofed, so once the carburetor has been qualified during manufacturing, the choke settings cannot be thereafter adjusted. Thus the emissions generated by the engine during its initial warm-up period can be controlled.

One problem with conventional choke opening mechanisms is the need to improve both cold starting and engine driveability while keeping engine emissions down during the choke cycle. This problem can be solved by providing some type of programmed control of the choke valve so its opening is more closely regulated than is currently the case using present mechanical systems. Such an electronic control strategy would have both improved cold-starting characteristics as well as improved engine driveability during the choke operating cycle.

SUMMARY OF THE INVENTION

Among the many objects of the present invention may be noted the provision of apparatus for controlling the opening of a choke valve on a carburetor for an internal combustion engine; the provision of the such apparatus to improve the cold-starting capability of the engine and engine driveability during the choke opening cycle; the provision of such an improvement for reducing emissions during the choke opening cycle; the provision of such apparatus for electronically controlling the opening of the choke valve; the provision of such apparatus for effectively tamperproofing the carburetor choke valve; the provision of such apparatus for replacing the present mechanical choke valve opening systems such as vacuum motors and bimetalic coils; and the provision of such apparatus which requires minimum parts and can be implemented at low cost.

Briefly, the apparatus of the present invention is for controlling the opening of a choke valve on a carburetor installed on a internal combustion engine. The carburetor has an air passage in which the choke valve is situated and the choke valve is mounted on a choke shaft movable to move the choke valve from a closed to an open position. The apparatus comprises an actuator to which is supplied signal elements of an electrical command signal. The actuator is responsive to these command signal elements to move the choke shaft and open the choke valve. A spring is connected to the actuator and to the choke shaft and exerts a force on the choke shaft when command signal elements are supplied to the actuator. A sensor senses the temperature of the engine and generates an electrical signal representative thereof. A processor processes the electrical signal, and generates and supplies signal elements of the electrical command signal to the actuator if the engine temperature represented by the electrical signal from the sensor is less than a predetermined engine temperature. Thus, the choke valve is fully opened when the engine temperature reaches the predetermined temperature. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 2:
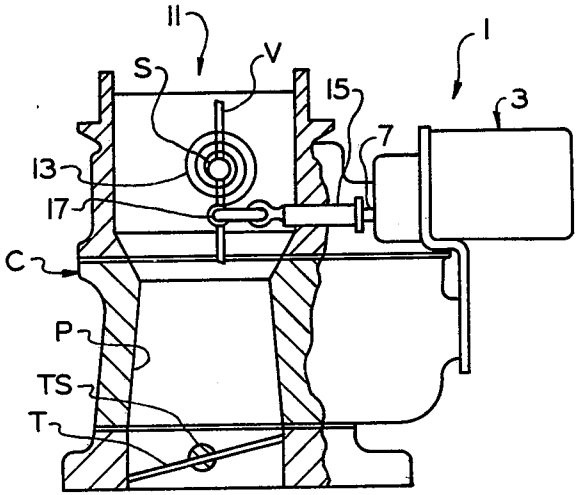
FIG. 2 is a side elevational view of the carburetor further illustrating the apparatus of the present invention.

Referring to the drawings, apparatus for controllably opening the choke valve V of a carburetor C installed on an internal combustion engine (not shown) is indicated generally 1. Carburetor C has an air passage P in which choke valve V is situated. Choke valve V is mounted on a choke shaft S movable to move the choke valve from a closed to an open position.

Figure 3:
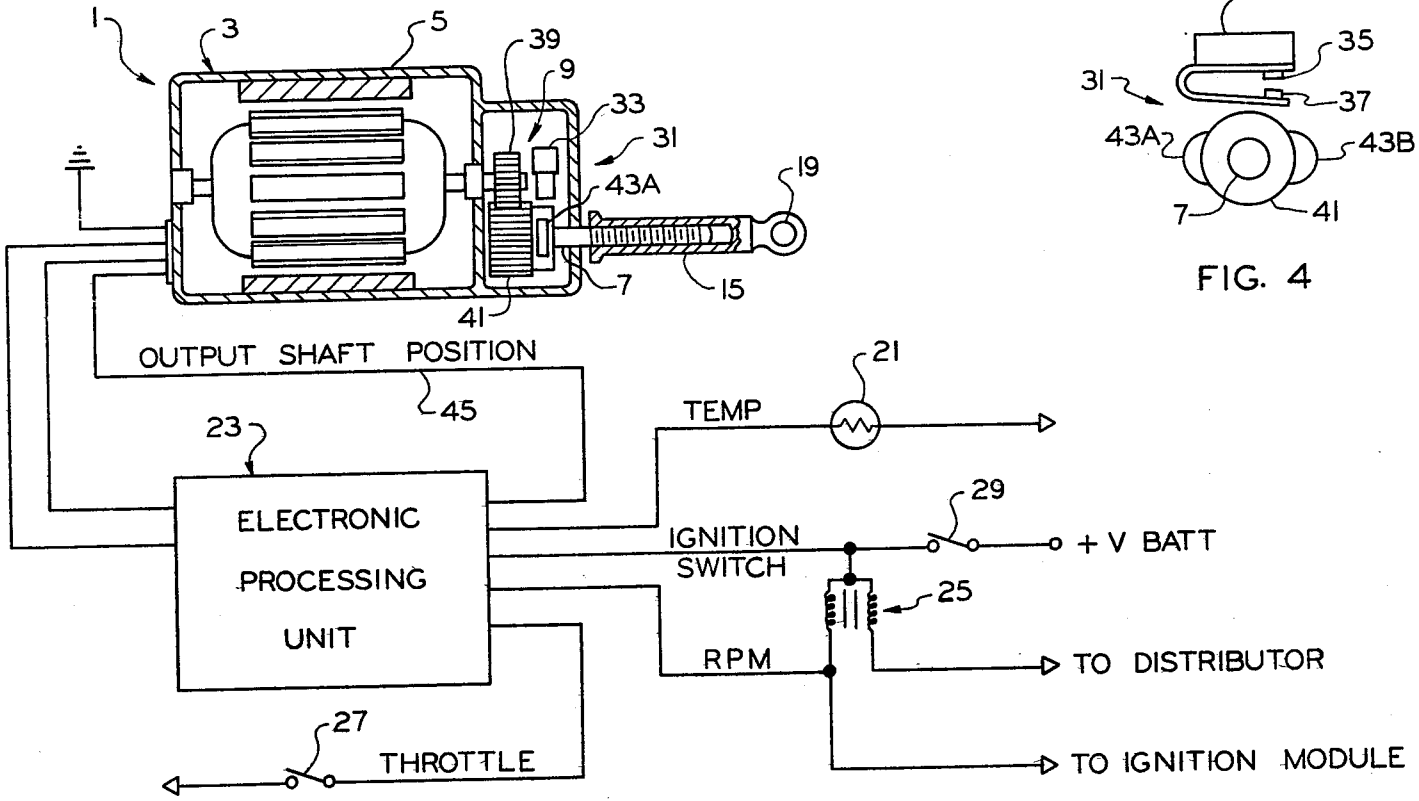
FIG. 3 is a sectional view of a portion of an actuator of the present invention together with a schematic representation of sensors and signal processing electronics of the apparatus.

Apparatus 1 comprises actuator means indicated generally 3 to which is supplied signal elements of an electrical command signal. Actuator 3 is a linear actuator and is responsive to command signal elements to move choke shaft S and open choke valve V. As best shown in FIG. 3, the linear actuator comprises a reversible D.C. motor 5 having an output shaft 7. A threaded sleeve 15 and fits over is threadably received on shaft 7 and is extendible and retractable. A gearing means 9 translates rotary movement of the motor into linear movement of the sleeve.

Apparatus 1 further includes spring means 11 connected to actuator means 3 and choke shaft S for exerting a choke valve opening force on the choke shaft when command signal elements are supplied to the actuator. Referring to FIG. 2, spring means 11 includes a wrap-up spring 13 one end of which is attached to an outer end of choke shaft S. A U-shaped linkage rod 17 has one leg fitting into an opening 19 in the outer end of sleeve 15 while the other leg of the linkage rod is secured to the other end of wrap-up spring 13. Consequently, movement of sleeve 15 is transmitted to wrap-up spring 13 via the linkage rod for the wrap-up spring to exert a choke valve opening force on choke shaft S.

Apparatus 1 next includes a sensing means 21 (see FIG. 3) for sensing the temperature of the engine on which carburetor C is mounted. Sensing means 21 generates an electrical signal representative of engine temperature. A processing means 23 comprises an electronic processing unit (EPU) responsive to the electrical signal developed by temperature sensing means 21 to process the electrical signal and generate and supply signal elements of the electrical command signal to linear actuator 3. The electronic processing unit controls opening of choke valve V by supplying elements of the command signal to actuator 3 while the engine is warming up. The engine has an initial or "cold-start" temperature and after it is started the temperature of the engine increases. As engine temperature increases, the electronic processing unit controllably opens choke valve V. Thus, when the engine temperature reaches a predetermined temperature, the choke valve is fully opened.

Since the engine does not always warm up while sitting at idle, it is important for the electronic processing unit to know when the engine is accelerated or decelerated as well as when it is idling. Thus, apparatus 1 further includes means 25 for sensing engine revolutions per minute (RPM) and for supplying a signal representative for engine RPM to the electronic processing unit. Means 25, for example, includes the ignition coil of the engine with the electrical signal representing RPM being developed on the primary side of the coil. Engine acceleration is denoted by an increase in RPM while deceleration is indicated by decreasing RPM. If the engine is being accelerated, it is desirable to partially close choke valve V so to enhance engine driveability during the acceleration. On the other hand, if the engine is being decelerated, it may be desirable to open choke valve V somewhat more than is determined strictly by engine temperature. Both conditions will be further described hereinafter with respect to the modes in which choke valve V is opened.

Figure 1:
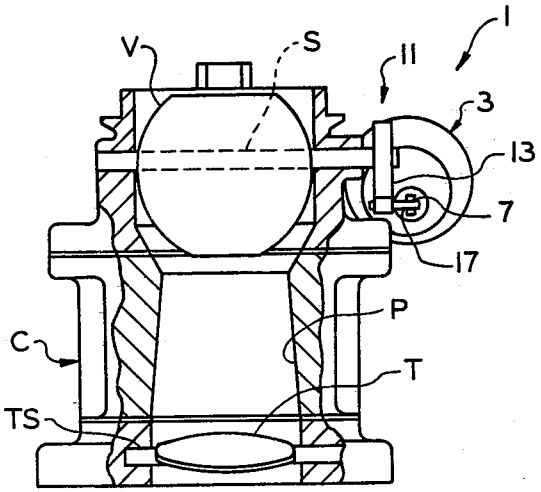
FIG. 1 is a front elevation, in section, of a portion of a carburetor illustrating the choke valve for the carburetor and a portion of the apparatus of the present invention.

As shown in FIGS. 1 and 2, carburetor C has a throttle valve T mounted on a throttle shaft TS. Apparatus 1 includes means 27 for sensing closure of throttle valve T and for supplying an electrical signal indicative of throttle valve closure to electronic processing unit 23. By sensing throttle valve closure, the electronic processing unit determines when the engine is at idle and this helps determine the rate at which choke valve V is opened.

Apparatus 1 next includes means 29 for sensing when the engine is turned on and off. Means 29 may be included with the ignition switch in which the operator of the vehicle inserts his key to turn the engine on. It is important to know when the engine is turned on or off so the electronic processing unit can determine when to establish an initial condition for opening choke valve V or when to terminate opening of the choke valve.

Figure 4:
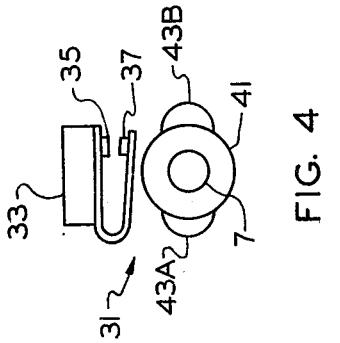
FIG. 4 is a front view of a switch installed in the actuator and a cam arrangement for closing the switch to provide positional information; and, FIG. 5 is a graph illustrating the profile for choke valve opening.

It is also important for proper operation of apparatus 1 that the position of choke valve V be known at all times. To facilitate this, actuator means 3 includes means for sensing position of output shaft 7 relative to a predetermined reference angle as an indication of the degree of choke valve opening. Further, an electrical signal is provided to electronic processing unit 23 each time output shaft 7 rotates an incremental angle from this reference point. Referring to FIGS. 3 and 4, a position sensing means 31 comprises an electrical switch 33 having a fixed contact 35 and a movable contact 37. Movable contact 37 is adjacent gearing means 9, the gearing means having means for contacting the movable contact to move it against fixed contact 35 to close switch 33. Gearing means 9 comprises a plurality of gears and as shown in FIG. 3, gearing means 9 includes a pinion gear 39 and a drive gear 41. The teeth of pinion gear 39 mesh with those of drive gear 41 so to translate the rotary movement of the reversible d.c. motor into linear movement of sleeve 15. Drive gear 41 includes two cam lobes 43A and 43B arranged opposite each other on the drive gear. These cam lobes contact movable contact 37 of switch 33 as drive gear 41 rotates and push contact 37 into closure with fixed contact 35 of the switch. Closure of switch 33 provides an electrical signal to electronic processing unit 23 over line 45 to indicate movement of output shaft 7. Thus, for every 180 degrees of rotation of drive gear 41, a signal is provided to the electronic processing unit indicating movement of output shaft 7. It will be understood that drive gear 41 may have more or less than two cam lobes 43 thereon, the number of cam lobes being a function of the degree of accuracy required of output shaft 7 and consequently choke valve V position.

Figure 5:
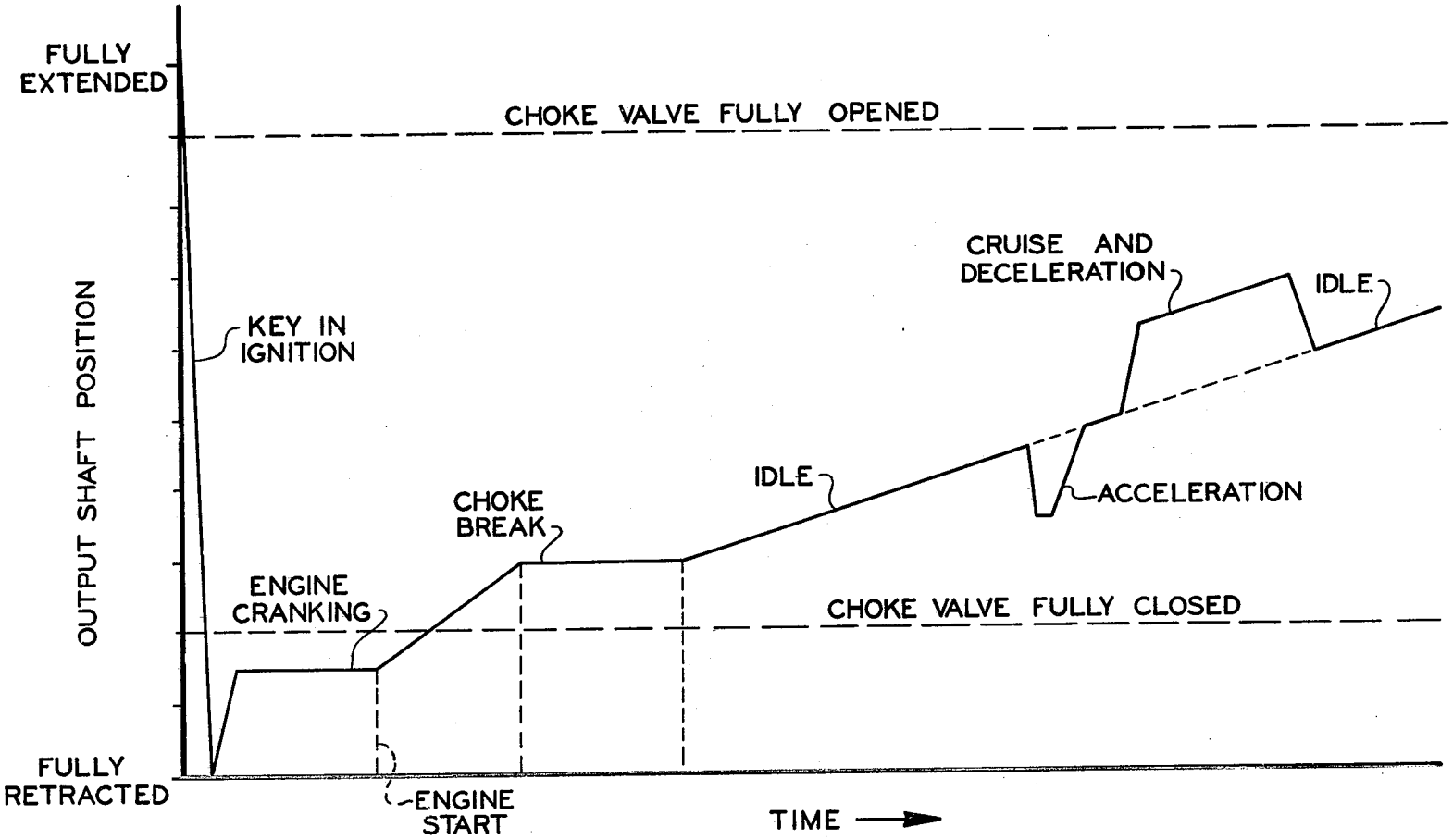

Operation of apparatus 1 to open choke valve V is best understood with reference to FIG. 5. FIG. 5 is a plot of the position of sleeve 15 against time. Assuming choke valve V is fully opened and the engine is turned off, the first step involved turning the ignition switch to "On". When this occurs, electronic processing unit 23 compares engine temperature as sensed by sensing means 21 against a reference temperature condition. If the engine temperature is above the reference condition, electronic processing unit 23 commands actuator means 3 to extend sleeve 15 so choke valve V is moved to its fully opened position. This is the condition that would occur for an engine "hot-start". If the sensed engine temperature is below the referenced temperature, a choke opening cycle is then started.

Assuming the engine is cold when the ignition switch is turned to "On", electronic processing unit 23 first commands linear actuator 3 to fully retract sleeve 15. As shown in FIG. 5, full retraction of the output shaft moves the choke valve to its fully closed position. This movement of the output shaft to its fully retracted position occurs at a very fast rate of travel. Once fully retracted, electronic processing unit 23 next commands actuator 3 to extend the output shaft until it reaches a position where it is maintained during engine cranking. This cranking position is temperature dependent, i.e. the higher the sensed engine temperature the more the output shaft will be extended and the more open choke valve V is. Since a cold engine has been assumed, the cranking position of sleeve 15 is such that choke valve V is still fully closed. During engine cranking, the torque developed on choke valve V by air flow counteracts the torque on choke shaft S created by wrap-up spring 13. This keeps choke valve V open an amount necessary for air flow to start the engine. When the engine starts, electronic processing unit 23 commands actuator 3 to extend sleeve 15 so choke valve V is moved from its fully closed to its choke break position.

This movement of the output shaft from engine start to choke break is at a slow rate of speed and is again engine temperature dependent. Once the choke valve has been moved to its choke break position, the electronic processing unit maintains the choke valve at this position for approximately 8–10 seconds. This allows the engine to stabilize.

After stabilization, electronic processing unit 23 commands actuator 3 to open choke valve V along the profile indicated IDLE in FIG. 5. As engine temperature increases, and as the engine idles, the choke valve is opened at a rate dependent upon the rate engine temperature increases. Since there is no vacuum break diaphragm unit to pull choke valve V open, the choke valve remains open as a result of the torque balance created by wrap-up spring 13 and air flow around the choke valve into the engine.

If an acceleration occurs during the engine warm-up period, extra air flow is developed and this causes choke valve V to blow open more than is desirable. The air-fuel ratio can cause engine hesitation during acceleration. To improve driveability during acceleration, actuator 3 is commanded to retract sleeve 15 and thus partially close choke valve V. Electronic processing unit 23 senses when an acceleration occurs both by the throttle closure switch 27 being open and by a sudden increase in engine RPM as sensed by sensing means 25.

During an engine cruise condition, driveability is enhanced and engine emissions reduced by electronic processing unit 23 commanding actuator 3 to open choke valve V slightly more than the degree determined by the IDLE profile. A cruise condition is determined by throttle closure switch 27 being open and by the sensed engine RPM being above some reference value, for example, 1,000 RPM. When throttle closure switch 27 closes, and if engine RPM is above the reference level, electronic processing unit 23 determines that an engine deceleration is occuring. For this condition, the choke valve is maintained at the slightly more open condition that was established during idle. If the engine is again idled, electronic processing unit 23 commands choke valve opening in accordance with the idle profile originally established. This condition is maintained until choke valve V was fully opened.

What has been described is apparatus for controllably opening a carburetor choke valve without use of a conventional vacuum diaphragm unit and bimetalic coil. Control of choke valve opening using the apparatus of the invention is advantageous because engine driveability and emissions are better controlled using an electronic processing unit such as the unit 23 to sense various changes in engine operating condition and to compensate for them by changing the degree of choke valve opening.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. Apparatus for controllably opening the choke valve of a carburetor installed on an internal combustion engine, the carburetor having an air passage in which the choke valve is situated and the choke valve being mounted on a choke shaft movable to move the choke valve from a closed to an open position, the apparatus comprising:

actuator means to which is supplied signal elements of an electrical command signal, the actuator means being responsive to the command signal elements to move the choke shaft and open the choke valve, and the actuator means including a d.c. motor having a movable output shaft and position sensing means for sensing the position of the output shaft relative to a fixed reference as an indication of the degree of choke valve opening;

spring means connected to the actuator means and the choke shaft for exerting a choke valve opening force on the choke shaft when command signal elements are supplied to the actuator means;

sensing means for sensing the temperature of the engine and generating an electrical signal representative thereof; and, processing means for processing an electrical signal from the sensing means and for generating and supplying signal elements of the electrical command signal to the actuator means if the engine temperature represented by the electrical signal from the sensing means is less than a predetermined engine temperature whereby the choke valve is fully opened when engine temperature reaches the predetermined temperature.

2. Apparatus as set forth in claim 1 further including means for sensing engine revolutions per minute (rpm) and supplying a signal representative thereof to the processing means, the processing means being responsive to a change in rpm such as occurs during an acceleration or deceleration to partially close the choke valve or move it to a more open position that that determined by engine temperature thereby to enhance engine driveability during engine warm-up.

3. Apparatus as set forth in claim 2 further including means for sensing closure of the carburetor's throttle valve and for supplying an electrical signal indicative thereof to the processing means to indicate an engine idle condition.

4. Apparatus as set forth in claim 3 further including a switch for sensing when the engine is turned on and off, the processing means being responsive to the position of the engine on-off switch being switched to on to command the actuator means to fully close the choke valve and to the engine on-off switch being switched off to terminate opening of the choke valve.

5. Apparatus as set forth in claim 4 wherein the d.c. motor is a reversible d.c. motor and includes an extendible and retractable sleeve operated by the output shaft and gearing means for translating rotary movement of the motor into linear movement of the sleeve.

6. Apparatus as set forth in claim 5 wherein the position sensing means comprises an electrical switch having a fixed and a movable contact, the movable contact being adjacent the gearing means and the gearing means having means for contacting the movable contact to move it against the fixed contact and close the switch.

7. Apparatus as set forth in claim 6 wherein the gearing means comprises a plurality of gears one of which includes a gear shaft having at least one cam lobe which contacts on the movable contact, as the gear rotates, to close the switch.

8. Apparatus as set forth in claim 5 wherein the spring means comprises a wrap-up spring one end of which is attached to an outer end of the sleeve.

9. Apparatus as set forth in claim 8 wherein a linkage rod is attached to the outer end of the sleeve and the other end of the wrap-up spring is secured to the linkage rod whereby linear movement of the sleeve results in the wrap-up spring exerting a choke valve opening force on the choke shaft.

10. Apparatus for controllably opening the choke valve of a carburetor mounted on an internal combustion engine in response to engine starting and warm-up comprising:

a wrap-up spring one end of which is attached to one end of a choke shaft one which the choke valve is mounted;

a reversible d.c. motor having an output shaft, an extendible and retractable sleeve operated by the output shaft and means for sensing the position of the output shaft relative to a fixed reference;

link means connecting the sleeve to the wrap-up spring for movement of the sleeve in the appropriate direction to increase or lessen the spring force acting on the choke shaft thereby to open or close the choke valve;

processing means for generating elements of an electrical command signal which are supplied to the d.c. motor for the d.c. motor to extend or retract the sleeve;

switch means responsive to operation of an ignition key to start the engine for providing a signal to the processing means when the engine is to be started, the processing means commanding the d.c. motor to return the sleeve to a reference position in response to the switch means signal; and, temperature sensing means for sensing engine temperature and for providing a signal representative of engine temperature to the processing means, the processing means commanding the d.c. motor to move the sleeve in the direction whereby the choke valve is opened, the amount of movement at any time being a function of sensed engine temperature at that time.

11. Apparatus as set forth in claim 10 further including means for sensing engine revolutions per minute (rpm) and supplying a signal representative thereof to the processing means, the processing being responsive to a change in rpm such as occurs during an acceleration or deceleration to partially close the choke valve or move it to a more open position than that determined by engine temperature thereby to enhance engine driveability during engine warmup.

12. Apparatus as set forth in claim 11 further including means for sensing closure of the carburetor's throttle valve and for supplying an electrical signal indicative thereof to the processing means to indicate an engine idle condition.

13. Apparatus as set forth in claim 10 wherein the d.c. motor has a gearing means for translating rotary movement of the motor to linear movement of the sleeve and the position sensing means comprises an electrical switch having a fixed and a movable contact, the movable contact being adjacent the gearing means and the gearing means having means for contacting the movable contact to move it against the fixed contact and close the switch.

14. Apparatus as set forth in claim 13 wherein the gearing means comprise a plurality of gears one of which includes a gear shaft having at least one cam lobe which contacts on the movable contact, as the gear rotates, to close the switch.

* * * * *